US010088257B2

(12) United States Patent
Popikov et al.

(10) Patent No.: US 10,088,257 B2
(45) Date of Patent: Oct. 2, 2018

(54) AUTO-LOADING SHOTGUN

(71) Applicant: L&O Hunting Group GmbH, Isny (DE)

(72) Inventors: Sergej Popikov, Weitnau (DE); Eugen Fester, Isny (DE); Peter Wiedemann, Scheuring (DE)

(73) Assignee: L&O HUNTING GROUP GMBH, Isny (DE)

( * ) Notice: Subject to any disclaimer, the term of this patent is extended or adjusted under 35 U.S.C. 154(b) by 0 days.

(21) Appl. No.: 15/628,717

(22) Filed: Jun. 21, 2017

(65) Prior Publication Data

US 2017/0370664 A1 Dec. 28, 2017

(30) Foreign Application Priority Data

Jun. 24, 2016 (DE) ..... 10 2016 111 603

(51) Int. Cl.

| | |
|---|---|
| ***F41A 9/14*** | (2006.01) |
| ***F41A 9/72*** | (2006.01) |
| ***F41A 3/12*** | (2006.01) |
| ***F41A 9/18*** | (2006.01) |
| *F41C 7/00* | (2006.01) |

(52) U.S. Cl.

CPC ..... *F41A 9/14* (2013.01); *F41A 3/12* (2013.01); *F41A 9/18* (2013.01); *F41A 9/72* (2013.01); *F41C 7/00* (2013.01)

(58) Field of Classification Search

CPC ..... F41A 9/14; F41A 9/18; F41A 9/64; F41A 9/13; F41A 9/15; F41A 9/19

See application file for complete search history.

(56) References Cited

U.S. PATENT DOCUMENTS

| | | | | |
|---|---|---|---|---|
| 3,919,800 | A * | 11/1975 | Browning | F41A 9/18 42/17 |
| 4,163,334 | A * | 8/1979 | Tollinger | F41A 15/14 42/25 |
| 9,417,019 | B2 * | 8/2016 | Norton | F41A 9/64 |
| 9,803,940 | B2 * | 10/2017 | Pittman | F41A 9/18 |
| 2011/0308126 | A1 | 12/2011 | Lesenfants | |
| 2014/0053716 | A1 * | 2/2014 | Norton | F41A 9/64 89/33.1 |

* cited by examiner

*Primary Examiner* — Stephen Johnson
*Assistant Examiner* — Joshua T Semick
(74) *Attorney, Agent, or Firm* — Paul D. Bianco; Fleit Gibbons Gutman Bongini & Bianco PL

(57) ABSTRACT

A self-loading shotgun includes a lock movable inside a lock housing between an open position and a closed position, a barrel, a magazine disposed below the barrel, a lock catch for holding the lock in the open position, and a feeder system for lifting a cartridge delivered from the magazine to the height of the barrel. The feeder system includes a feeder that swivels about a transverse axis and a magazine hatch that interacts with the lock catch. To allow the self-loading shotgun to be fully loaded even when the lock is open, the swivel movement of the feeder generated by the lock is controlled by a control element separate from the lock catch.

17 Claims, 12 Drawing Sheets

AUTO-LOADING SHOTGUN

FIELD OF THE DISCLOSURE

The present disclosure relates to an auto-loading shotgun.

BACKGROUND

This type of auto-loading shotgun is known from US 2011/0308126 A1. It comprises a lock movable inside a lock housing between an open position and a closed position, a barrel, a magazine disposed below the barrel, and a feeder system for lifting a cartridge delivered from the magazine to the height of the barrel. The feeder system comprises a feeder consisting of two separate components, with a lower component that swivels about a transverse axis and the actual loading port that swivels independently of the lower component about the transverse axis. A lever interacting with the lock is hinged to the lower component of the feeder, which lever has a dual function. On the one hand, the lever hinged to the lower component of the feeder holds the lock in the open position and thereby functions as a lock catch when the lower component of the feeder is prevented from moving upwardly by a lateral magazine hatch. On the other hand, the lever hinged to the lower component of the feeder serves as a control element, by means of which the lower component of the feeder, together with the loading port, is lifted so as to be able to insert a cartridge into the barrel when the lock travels forwardly into the closed position. Because of the two-component design of the feeder with its upwardly swiveling loading port, this prior-art self-loading shotgun allows a cartridge to be inserted into the magazine even when the lock is open; however, this cartridge is not retained in the magazine, but instead is pushed onto the loading port after the loading port has been swiveled back by the magazine spring. At the same time, the magazine hatch is swiveled by the cartridge now disposed on the loading port in such a manner that the lower component of the feeder is released and can be swiveled upwardly together with the loading port. Via the lever hinged to the lower component of the feeder, the lock is released at the same time so as to be able to move into a closed and locked position. Since during the insertion of a cartridge the lock is actuated as well, this self-loading shotgun cannot be loaded independently of the locking movement.

SUMMARY OF THE DISCLOSURE

Thus, the disclosure relates to a self-loading shotgun of the type mentioned above, which can be fully loaded even if the lock is open.

Useful configurations and further advanced modifications of the disclosed self-loading shotgun are also described herein.

In the self-loading shotgun according to the disclosure, the swiveling movement of the feeder induced by the lock is controlled by a control element that is separate from the lock catch. The control element for controlling the movement of the feed, which interacts with the lock, and the lock catch for holding the lock in an open position are designed as separate components that are not connected to each other. When the lock is open, the feeder is not blocked and the magazine hatch moves into position. The two components are separate from each other, thereby allowing the magazine to be fully loaded when the lock is open.

According to an especially useful embodiment, the control element interacting with the lock is hinged to an end of the feeder so as to be able to swivel about an axis parallel to the transverse axis, said end, as seen when looking in the downrange direction, projecting rearwardly with respect to the transverse axis.

The magazine hatch is preferably connected to the lock catch by means of a lock catch actuating element that is swivel-mounted on the feeder. The lever-shaped lock catch actuating element can be hinged to an upwardly projecting bearing part of the feeder so as to be able to swivel about a swivel axis perpendicular relative to the transverse axis. This causes the lock catch actuating element to be swiveled together with the feeder.

It is recommended that the lock catch actuating element be configured in the form of a two-arm lever, with the rearward end, as seen when looking in the downrange direction, of the lock catch actuating element interacting with the lock catch that is disposed on a trigger carrier so as to swivel about an axis parallel to the axis of the magazine hatch.

By means of a lock catch trigger, the lock catch can be manually moved into a release position so as to unblock the lock.

A linearly movable stop lever for detachably holding the magazine hatch in a locked position can be dedicated to the magazine hatch. The stop lever can preferably be moved via a hammer disposed in the lock housing from the position of engagement with the magazine hatch to a release position. This allows the magazine hatch to be controlled by the hammer.

According to a useful embodiment, the stop lever can be moved by the hammer via a tilting lever. The tilting lever can be disposed on a trigger carrier or locking plate, but also on the feeder.

BRIEF DESCRIPTION OF THE DRAWINGS

Other special features and advantages of the disclosure follow from the description of a preferred practical example with reference to the drawings. The figures show.

DETAILED DESCRIPTION

Figure 1:
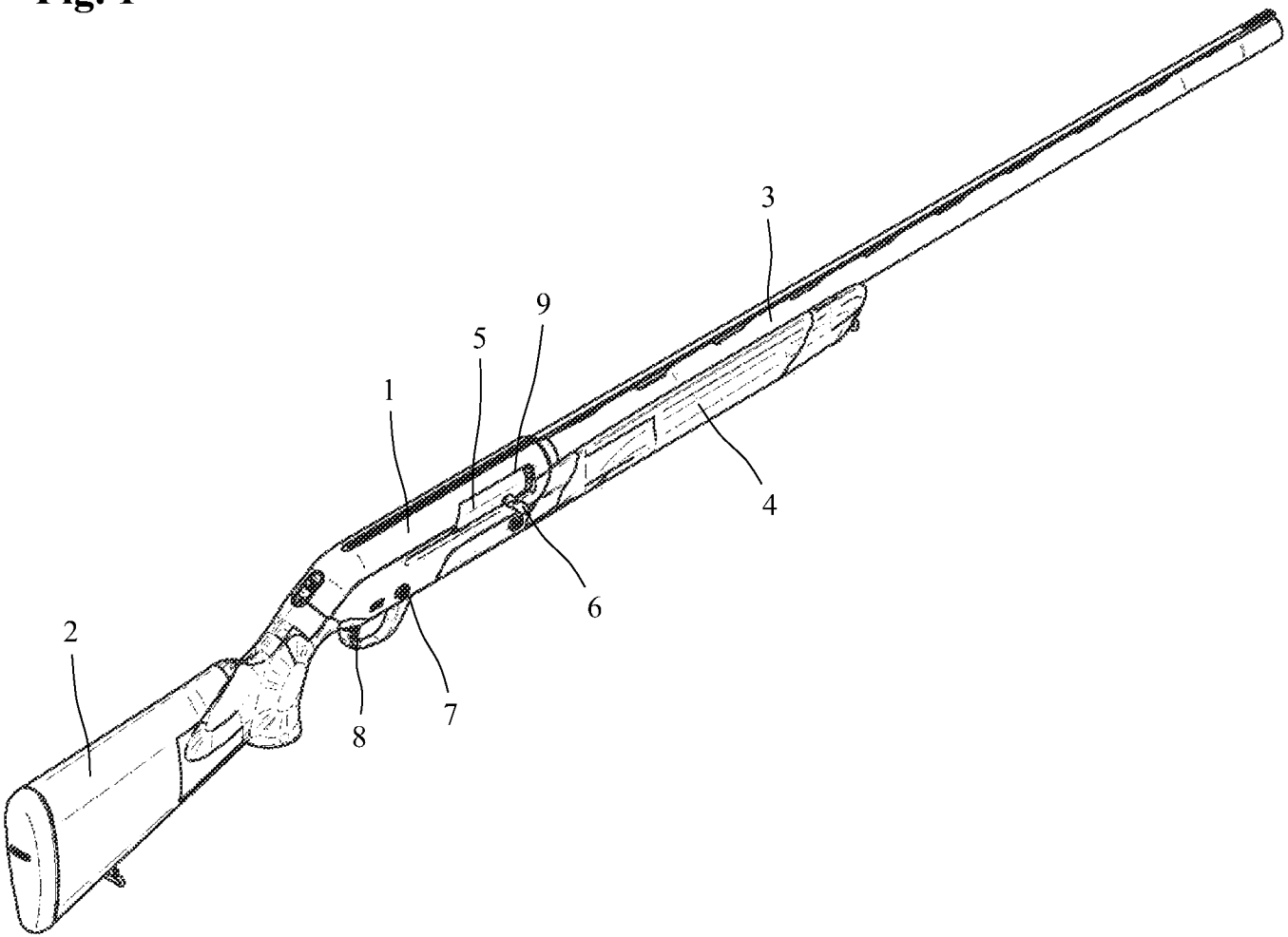
FIG. 1 a perspective view of a self-loading shotgun.

The self-loading firearm in the diagrammatic representation shown in FIG. 1 comprises a lock housing 1, also known as a system box, a stock 2 disposed on the rearward end of the lock housing 1, a barrel 3 projecting from the forward end of the lock housing 1, and a forearm 4 disposed below the barrel 3. In addition, the self-loading firearm, here configured in the form of a self-loading rifle, also comprises a locking system disposed inside the lock housing 1 with a lock carrier 5 that, in the longitudinal direction of the barrel 3, travels between an open position and a closed position and that, when a shot is fired, is pushed back by the recoil against a compression spring or can be manually actuated by means of a loading lever 6. The locking system further comprises a trigger carrier 7, also known as a locking plate, having a trigger guard, with a trigger 8 being disposed on the trigger carrier. The trigger carrier 7 is detachably affixed to the lower face of the lock housing 1 where a lateral cartridge ejection window 9 is disposed.

As FIG. 2 indicates, in addition to the lock carrier 5 and the trigger carrier 7, the self-loading firearm comprises a tubular magazine 10 disposed below the barrel 3 for receiving a plurality of cartridges 11 disposed one behind the other. Attached to the end of the barrel 3, which end faces rearwardly toward the lock carrier 5, is a locking sleeve 12. In the embodiment shown, the locking sleeve 12 is screwed via a thread 13 to the rearward end of the barrel 3. In the lock carrier 5, a locking head 14 and a compression spring-biased firing pin 15 are disposed. In addition, the self-loading firearm also comprises a feeder system, by means of which a cartridge 11 delivered by means of a magazine spring (not shown) from the magazine 10 can be lifted to the height of a cartridge chamber 16 on the rearward end of the barrel 3 and inserted by the downstream lock carrier 5 into the cartridge chamber 16.

Figure 2:
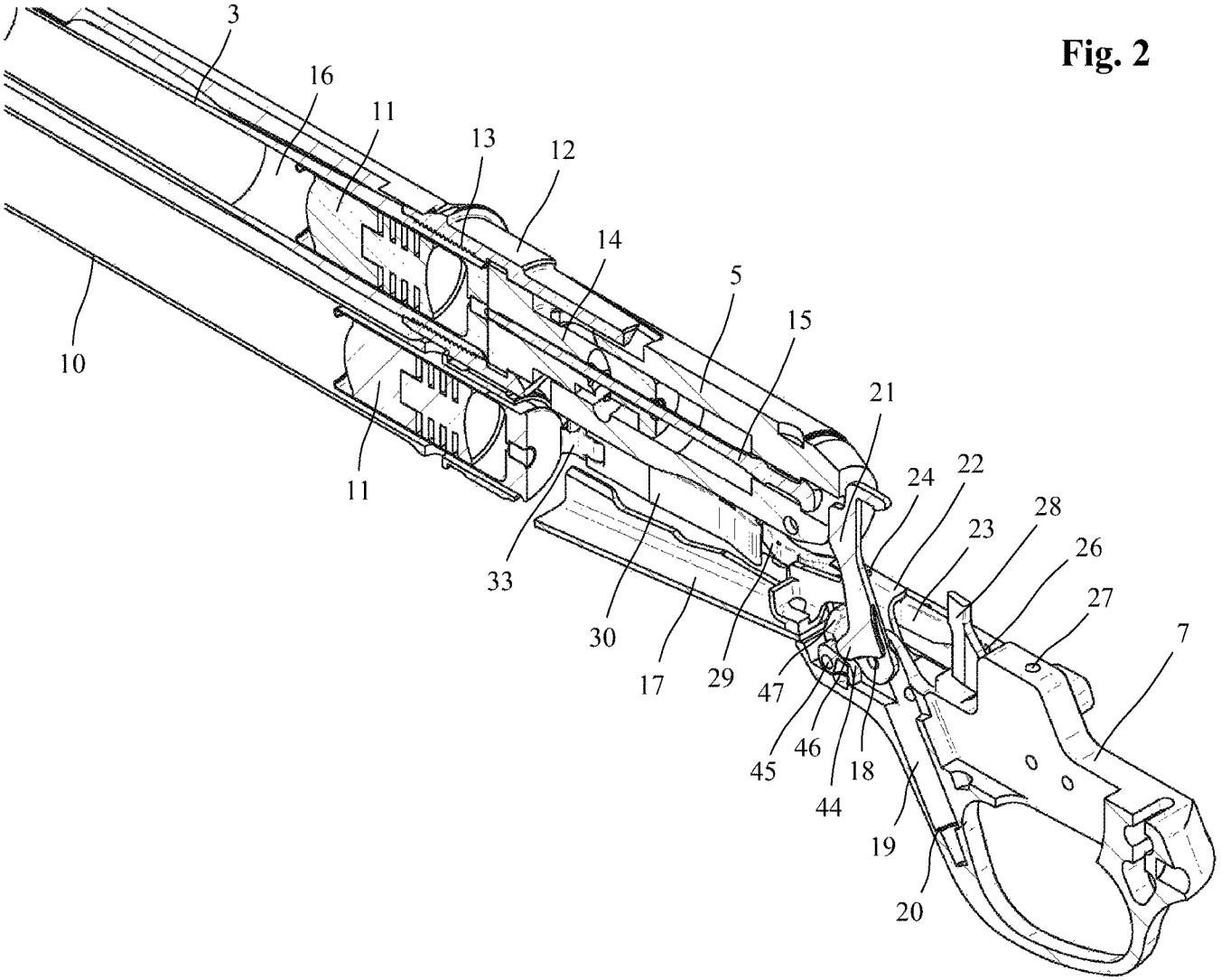
FIG. 2 a sectional view of the locking system of the self-loading shotgun shown in FIG. 1.

As FIG. 2 indicates, the feeder system contains a gate-shaped feeder 17 that is disposed on the trigger carrier 7 so as to be able to swivel about a transverse axis 18, which extends at right angles relative to the axis of the barrel, between a lower receiving position and an upper feeding position. In addition, a hammer 21 activated by a tension rod 19 and a compression spring 20 is disposed on the trigger carrier 7 so as to be able to pivot about the transverse axis 18 into a forward firing position. In the lower receiving position of the gate-shaped feeder 17, a cartridge 11 delivered from the magazine 10 can be pushed onto the feeder 17. By swiveling the feeder 17 into the upper feeding position, the cartridge 11 can be lifted to the height of the cartridge chamber 16. In the lower receiving position, a cartridge feed opening on the lower face of the lock housing 1 is covered by the feeder 17.

Figure 3:
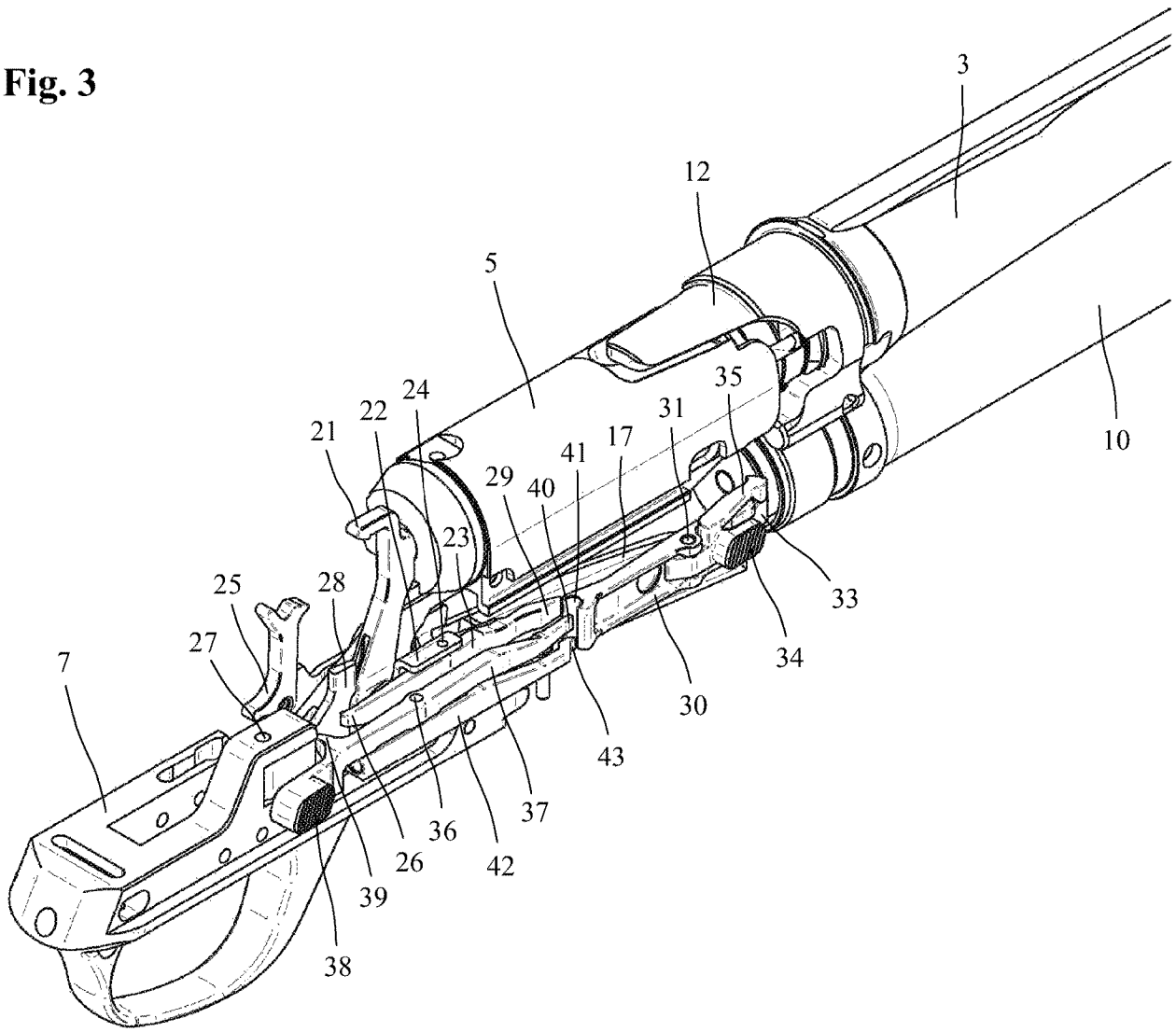
FIG. 3 a perspective view of the locking system of the self-loading shotgun shown in FIG. 1.

FIGS. 2 and 3 show that a lever-shaped lock catch actuating element 23 is hinged to an upwardly projecting bearing part 22 of the gate-shaped feeder 17 so as to be able to swivel about a swivel axis 24 perpendicular both relative to the transverse axis 16 and relative to the axis of the barrel 3. In addition, a lever-shaped control element 25 interacting with the lock carrier 5 as shown in FIG. 3 for controlling the swivel movement of the feeder 17 as a function of the movement of the lock carrier 5 is hinged to an end of the gate-shaped feeder 17, said end, as seen when looking in the downrange direction, projecting rearwardly relative to the transverse axis 18.

The lock catch actuating element 23 shown in FIG. 3 is configured in the form of a two-arm lever that swivels about the swivel axis 24, the rearward end 26 of which lever, as seen when looking in the downrange direction, interacts with a lock catch 28 that swivels about an axis 31 on the trigger carrier 7. Via the lock catch actuating element 23, the lock catch 28 is pushed by a cartridge 11 delivered from the magazine 10 to the feeder 17 inwardly into a release position. To this end, the forward end 29, as seen when looking in the downrange direction, of the lever-shaped lock catch actuating element 23 has a contact surface for making contact with the cartridge 11. The forward end 29 of the lock catch actuating element 23 is pushed outwardly by a cartridge 11 that on the feeder 17 is in the rearward position, which causes the rearward end 26 of the lock catch actuating element 23 to push the lock catch 28 inwardly into the release position for releasing the lock carrier 5. A spring (not shown) pushes the lock catch 28 outwardly into a holding position for holding the lock carrier 5 in a rearward open position.

In the lock housing 1, a magazine hatch 30 shown in FIG. 3 is disposed so as to be able to swivel about an axis 31 perpendicular relative to the axis of the barrel 3. On the forward end, as seen when looking in the downrange direction, the magazine hatch 30 that swivels at right angles relative to the long axis of the magazine 10 has a tooth-like holding element 33 for holding a cartridge 11 inside the magazine 10, which holding element swivels about a further axis 32. In addition, a toothed lever 35 having a push knob 34 and swiveling about the axis 31 is hinged to the magazine hatch 30. The tooth-like holding element 33 and the toothed lever 35 are connected to each other by means of a scissor-type hinge in such a way that the tooth-like holding element and the toothed lever are swiveled in opposite directions. For example, if the toothed lever 35 is pushed inwardly by the push knob 34, the tooth-like holding element 33 swivels in the outward direction.

In addition, downstream of the magazine hatch 30, as seen when looking in the downrange direction, a lock catch trigger 37 swiveling about an axis 36 is disposed in the lock housing 1. On its rearward end, as seen when looking in the downrange direction, the lock catch trigger 37 has an outwardly facing push knob 38, which can be activated from the outside of the lock housing 1, and an inwardly protruding projection 39 for manually moving the lock catch 28 into the release position. On its forward end, as seen when looking in the downrange direction, the lock catch trigger 37 has a lug 40 that engages in a semicircular depression 41 on the rearward end, as seen when looking in the downrange direction, of the magazine hatch 30. Thus, it is possible to also swivel the magazine hatch 30 via the lock catch trigger 37.

Figure 4:
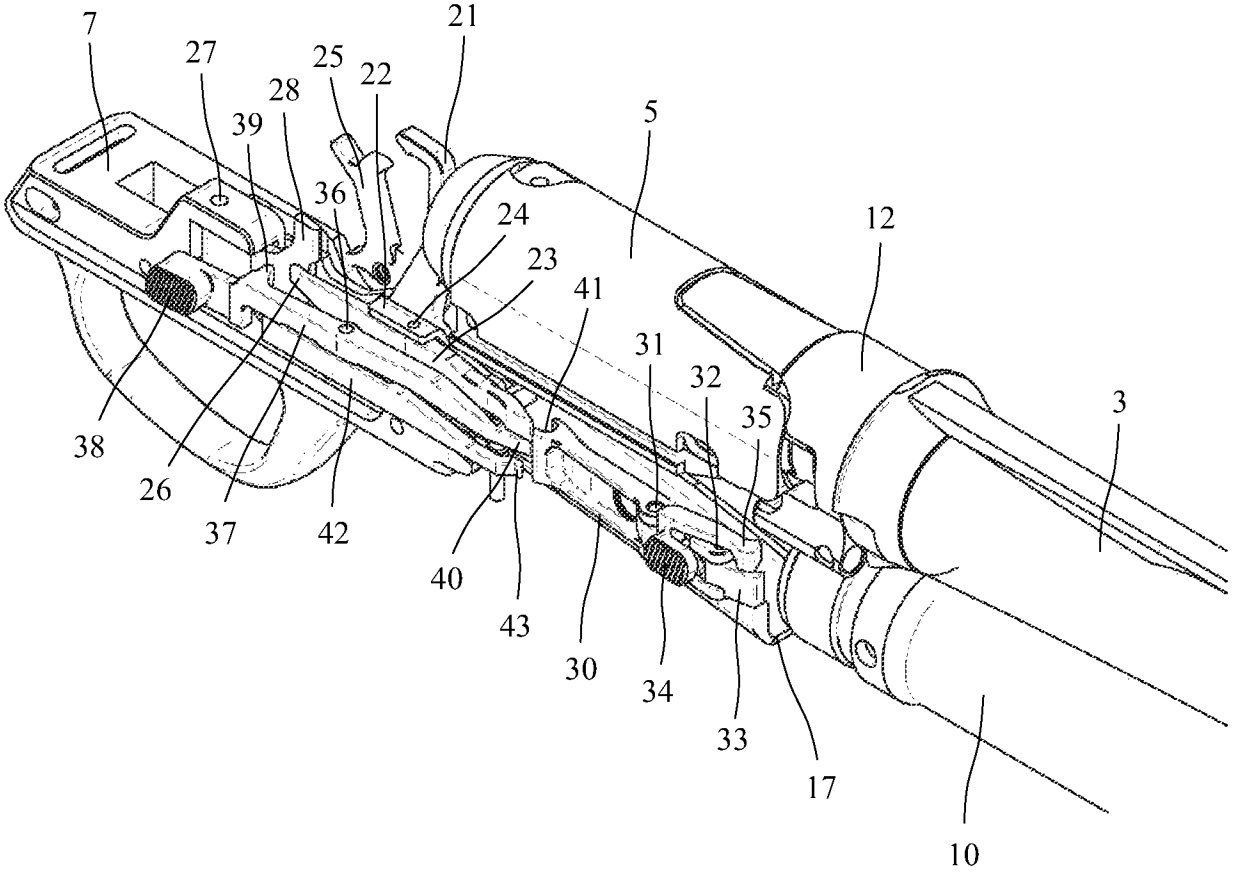
FIG. 4 a further perspective view of the locking system of the self-loading shotgun shown in FIG. 1.

As FIGS. 3 and 4 indicate, a stop lever 42 for detachably holding the magazine hatch 30 in a locked position is disposed below the lock catch trigger 37, said stop lever being able to move parallel relative to the axis of the barrel 3 and parallel relative to the axis of the magazine 10. The stop lever 42 is slidably guided linearly on the axis 36 in a slotted hole and is pushed forwardly, as seen when looking in the downrange direction, by a compression spring (not shown). On its front end, as seen when looking in the downrange direction, the stop lever 42 has a stop lug 43 for locking engagement in the semicircular depression 41 on the rearward end, as seen when looking in the downrange direction, of the magazine hatch 30. By means of a tilting lever 44 shown in FIG. 2, which can be actuated by the hammer 21, the stop lever 42 can be moved rearwardly, as seen when looking in the downrange direction, against the force of the compression spring so that the stop lug 43 becomes disengaged from the depression on the magazine hatch 30. The tilting lever 44 shown in FIG. 2 is mounted in the trigger carrier 7 below the hammer 1 so as to be able to pivot about a transverse axis 45 and can be tilted by the lug-shaped projection 46 on the lower face of the hammer 21 so as to move the stop lever 42. To this end, the tilting lever 44 has a laterally inwardly projecting lug 47 for moving the stop lever 42.

The mechanism of operation of the self-loading shotgun described above will be explained with reference to FIGS. 5-12 below.

Figure 5:
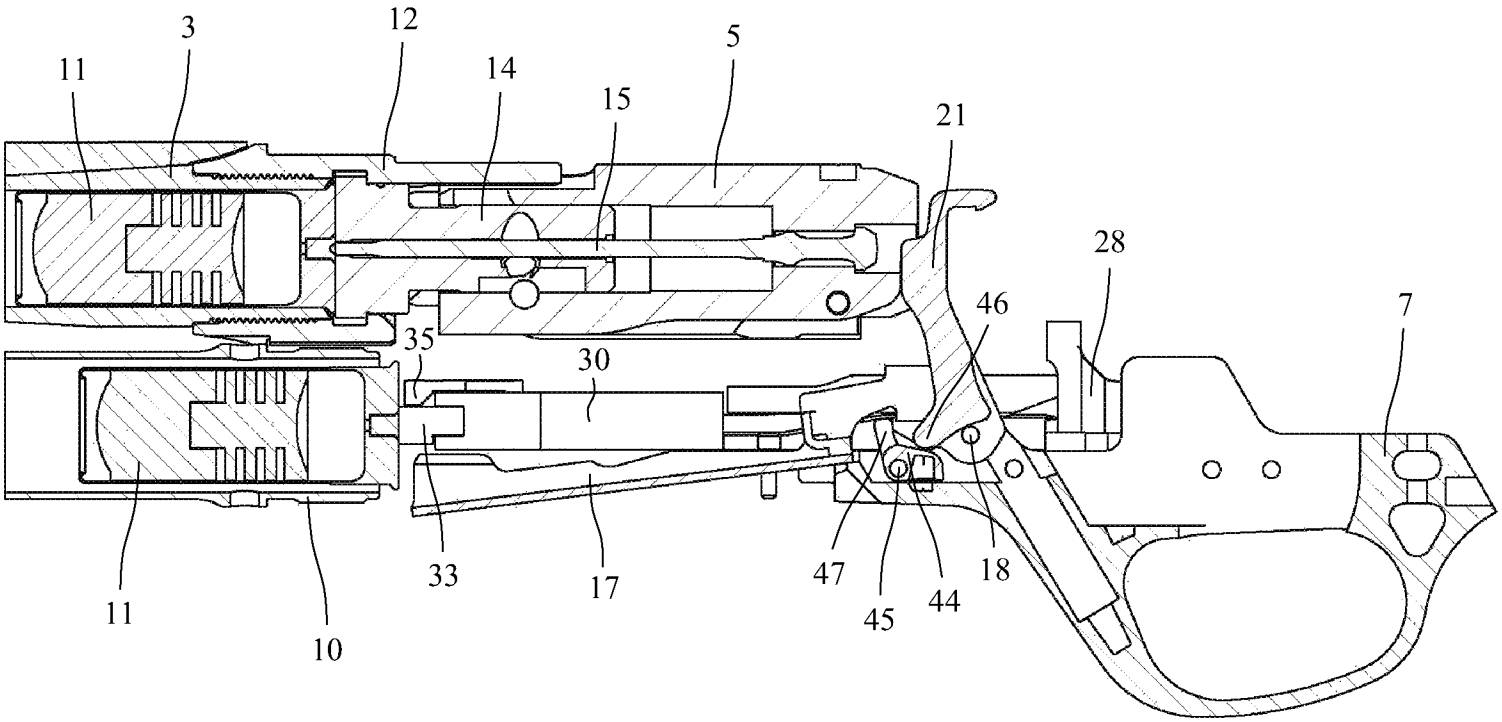
FIG. 5 a sectional view of the locking system shown in FIG. 3 shortly after releasing the hammer.
Figure 6:
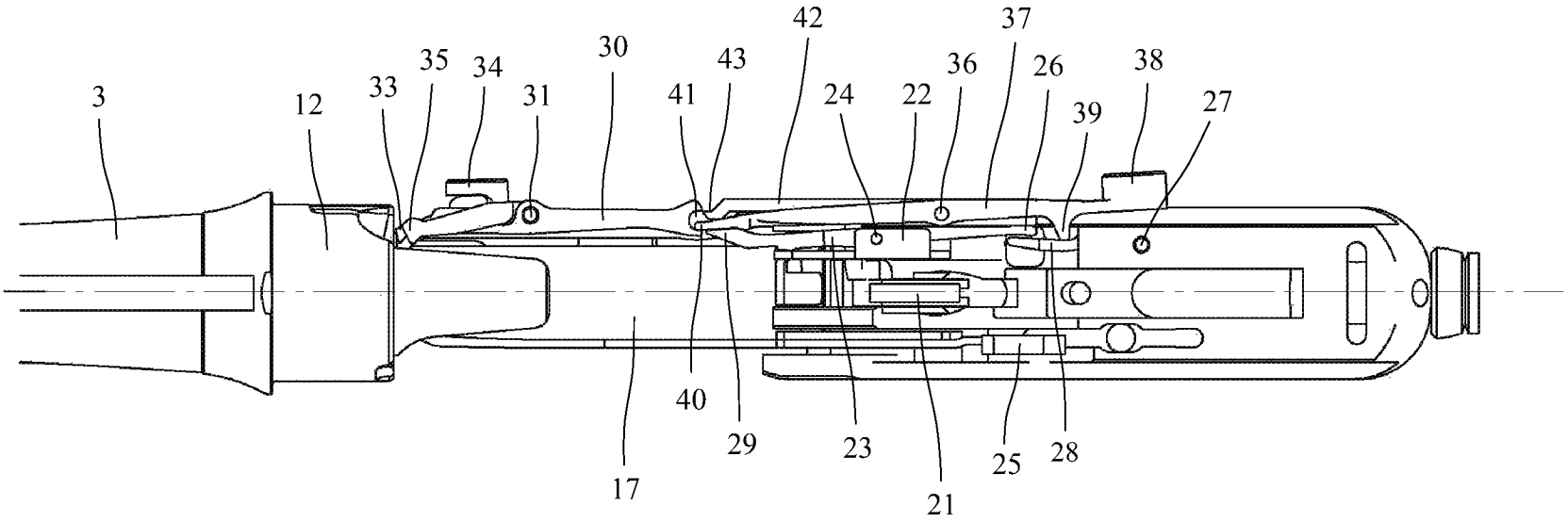
FIG. 6 a top view of the locking system shown in FIG. 3 shortly after releasing the hammer.

When the trigger 8 shown in FIG. 1 of a loaded, cocked, and safety-off weapon is pulled, thereby moving the compression spring-actuated hammer 21 into the forward firing position shown in FIG. 5, the tilting lever 44 is tilted by the lug-shaped projection 46 of the hammer 21 about the transverse axis 45 in such a way that the inwardly projecting lug 47 of the tilting lever 44 pushes the stop lever 42 rearwardly against the force of the compression spring exerted on the stop lever 42 in the forward direction, as seen when looking in the downrange direction, so that the stop lug 43 on the stop lever 42 becomes disengaged from the magazine hatch 30 as illustrated in FIG. 6.

Figure 7:
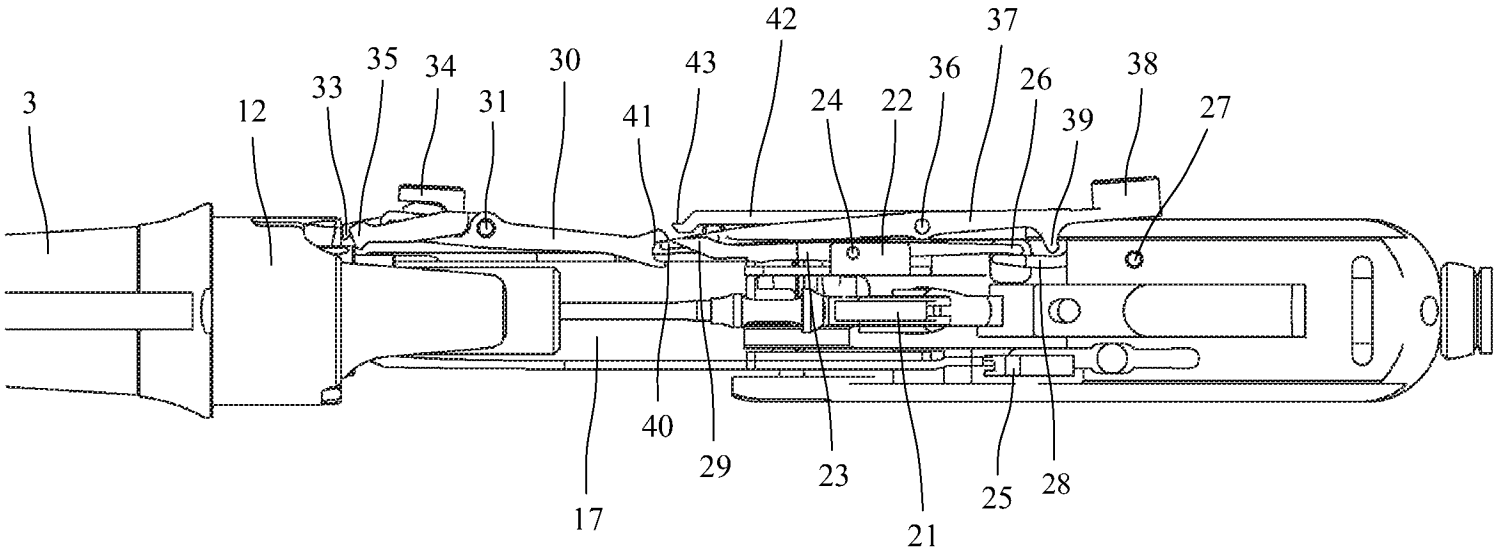
FIG. 7 a top view of the locking system shown in FIG. 3 with a magazine hatch in the locked position.

When the hammer 21, during its movement into the firing position, pushes the stop lever 42 by means of the tilting lever 44 from the position of engagement with the magazine hatch 30, the spring-biased magazine hatch 30 can pivot about the axis 31 from the locked position shown in FIG. 6 into an open position as shown in FIG. 7. In the open position of the magazine hatch 30, the rearward part, as seen when looking in the downrange direction, of the magazine hatch 30 with the depression 41 is swiveled inwardly, while the forward part with the tooth-like holding element 33 holding the cartridge 11 in the magazine is swiveled outwardly. This causes a cartridge 11 contained in the magazine 10 to be released. With its lower face, the magazine hatch 30 moves into a position above the edge of the feeder 17 so that the feeder 17 cannot be impelled upwardly by the forces, pulses, or shocks generated when the shot is fired and thus is able to prevent the delivery of a new cartridge 11. By means of the holding element 33 swiveled outwardly into a position above the magazine hatch 30, a cartridge 11 contained in the magazine 10 is released for delivery to the feeder 17.

Figure 8:
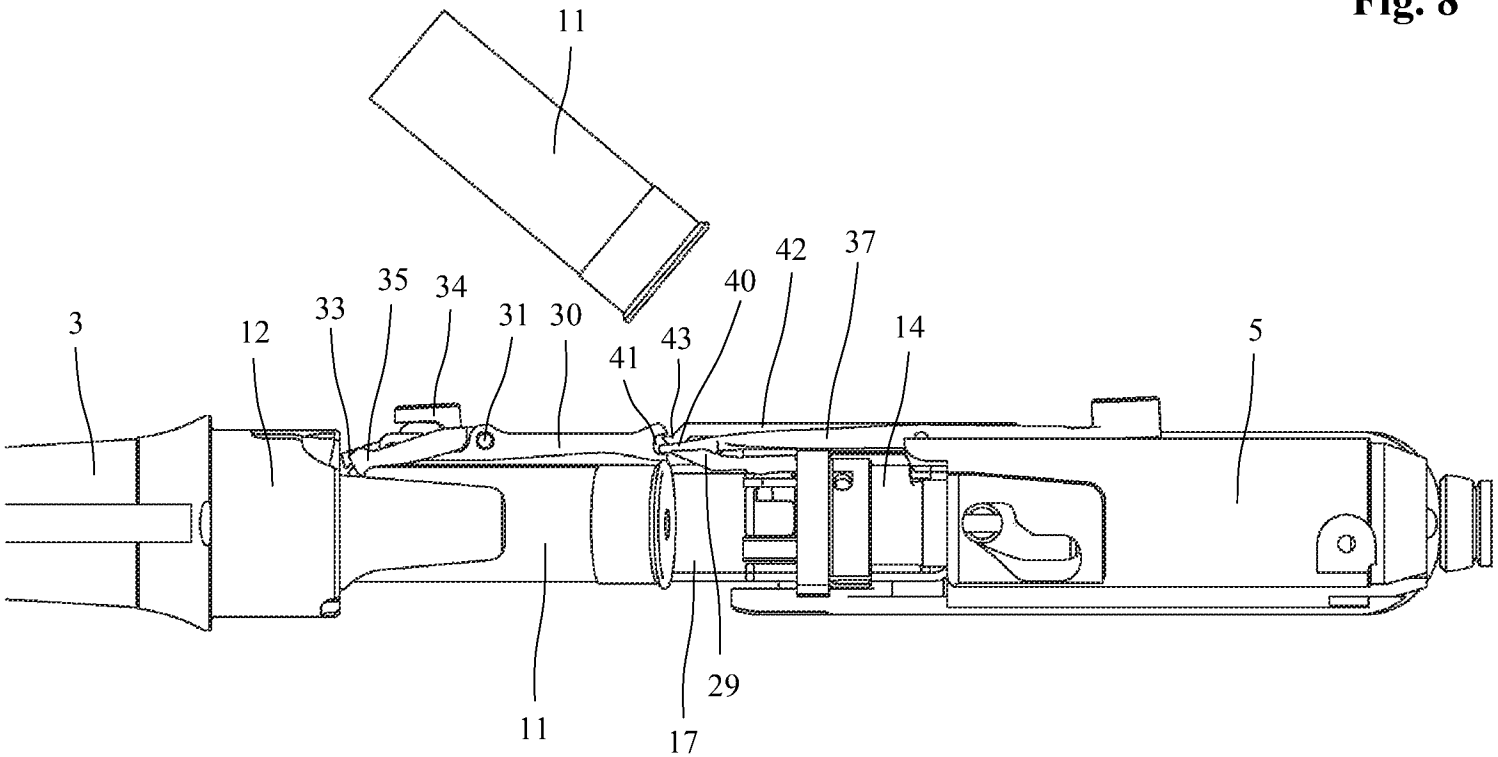
FIG. 8 a top view of the locking system shown in FIG. 3 with an open lock.
Figure 9:
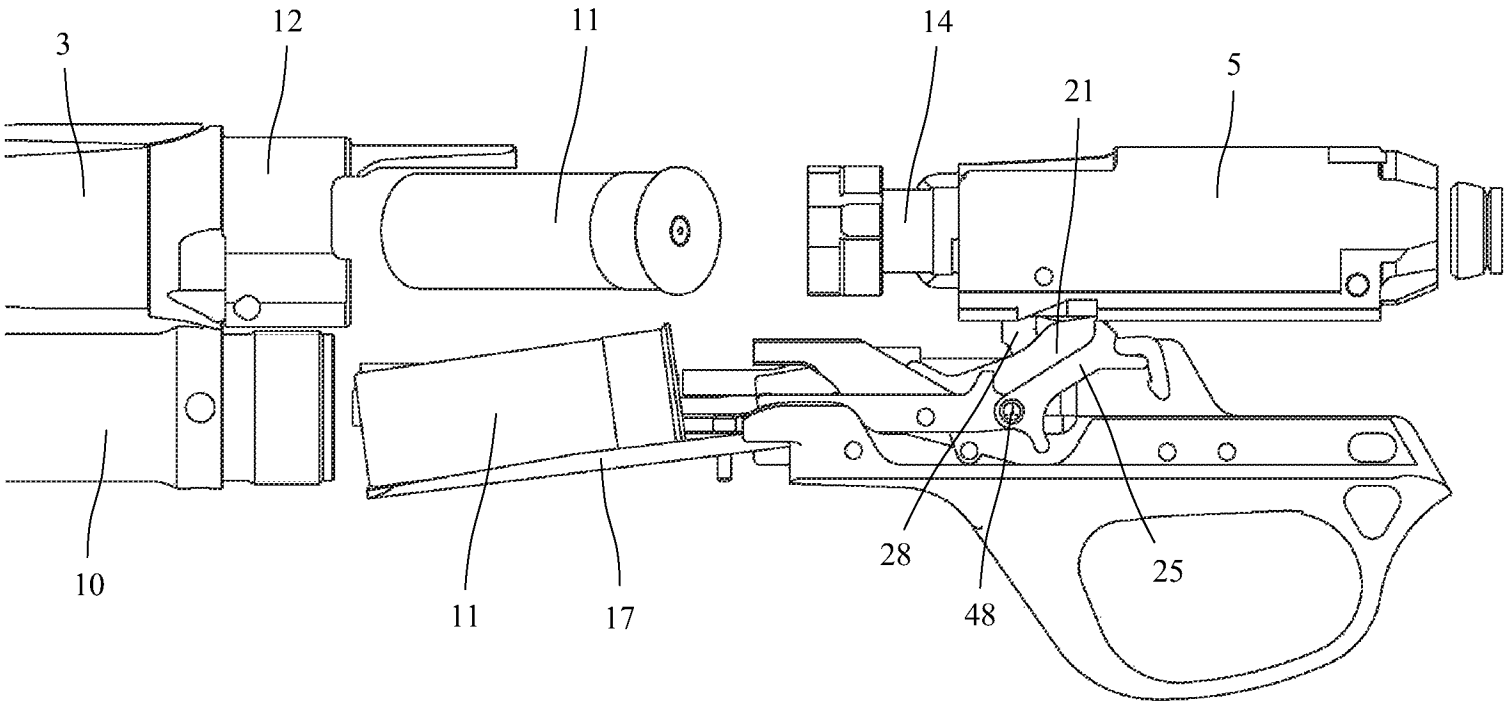
FIG. 9 a lateral view of the locking system shown in FIG. 3 during rearward movement of the lock.

After a shot has been discharged, the lock carrier 5 with the locking head 14 travels back as shown in FIGS. 8 and 9, and the empty cartridge 11 is extracted in a manner known in the prior art from the barrel 3 by means of an extractor hook and ejected by an ejector through the cartridge ejection window 9. After reaching the end of the return path, the lock carrier 5 with the locking head 14 is again pushed forwardly by a compression spring (not shown). This causes the lock carrier 5 to engage in the lock catch shown in FIG. 9, where it is retained for the time being. FIG. 9 also shows that the hammer 21 is swiveled rearwardly by the returning lock carrier 5 for holding it in a cocked position. In addition, the returning lock carrier 5 also tilts the control element 25, which is hinged to the rearward end of the feeder 17 so as to be able to swivel about an axis 48, rearwardly as seen when looking in the downrange direction.

FIGS. 8 and 9 also show that after a shot has been fired and the lock carrier 5 has returned, a new cartridge 11 is delivered from the magazine 10 to the feeder 17. However, this takes place with a delay of time since, as a result of the recoil during the firing of a shot, the cartridges 11 contained in the magazine, because of their inertia, first move slightly forwardly, while the lock carrier 5 returns much earlier, thereby allowing the lock carrier 5 to latch into an engaging position on the lock catch 28 before a cartridge 11 contained in the magazine 10 is moved by a magazine spring onto the feeder 17.

As the cartridge 11 moves on the feeder 17, the cartridge 11 first slides along the magazine hatch 30 as shown in FIG. 8, with the wider rearward end of the magazine hatch 30 again being pushed outwardly by the edge of the cartridge 11 and held in the locked position by the stop lug 43 of the stop lever 42. The length of the magazine hatch 30 that swivels about the axis 31 is dimensioned to ensure that the tooth-like holding element 33, which is swivel-mounted on the magazine hatch 30, holds back the second cartridge exiting from the magazine 10 before the feeder 17 is unlocked by the magazine hatch 30 swiveling outwardly.

Figure 10:
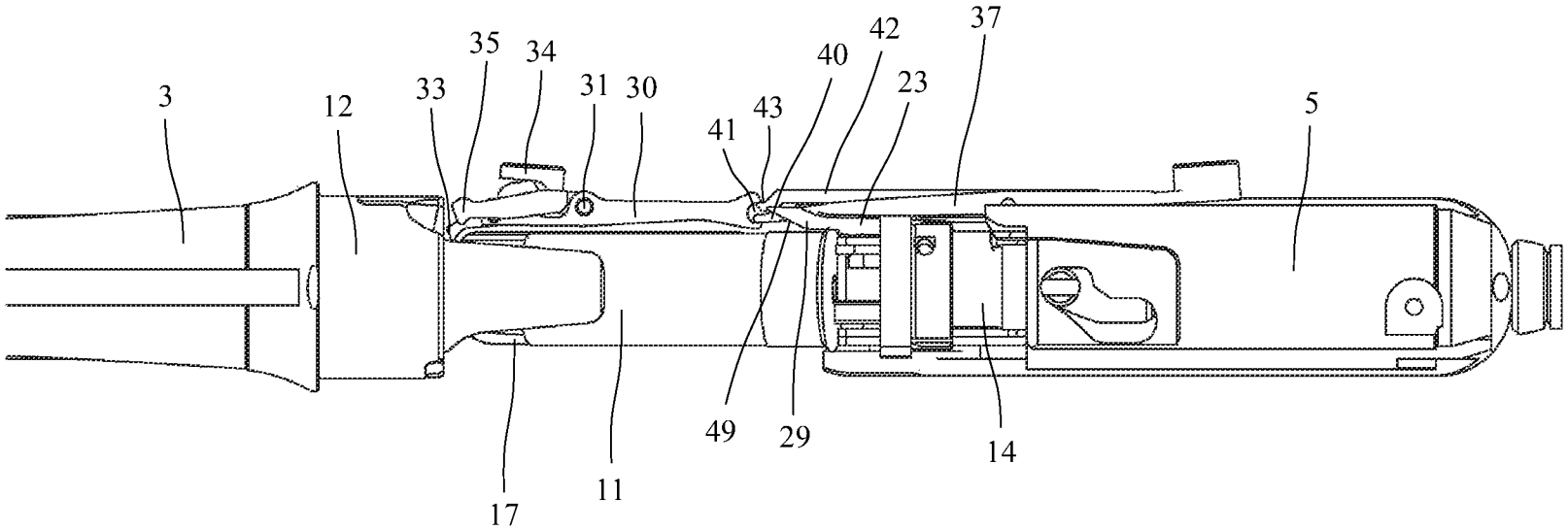
FIG. 10 a top view of the locking system shown in FIG. 3 with the lock in a rearward end position.

Subsequently, as shown in FIG. 10, the cartridge 11, during its further travel on the feeder 17, comes into contact with the forward end 29 of the lock catch actuating element 23 and pushes it with the edge of the cartridge 11 on an inside slope 49 outwardly. This causes the rearward end 26 of the lock catch actuating element 23, which swivels about the axis 24, to be moved inwardly and the lock catch 28 to be moved into a release position. As a result, the lock carrier 5 is released and, actuated by a compression spring, is able to travel forwardly.

Figure 11:
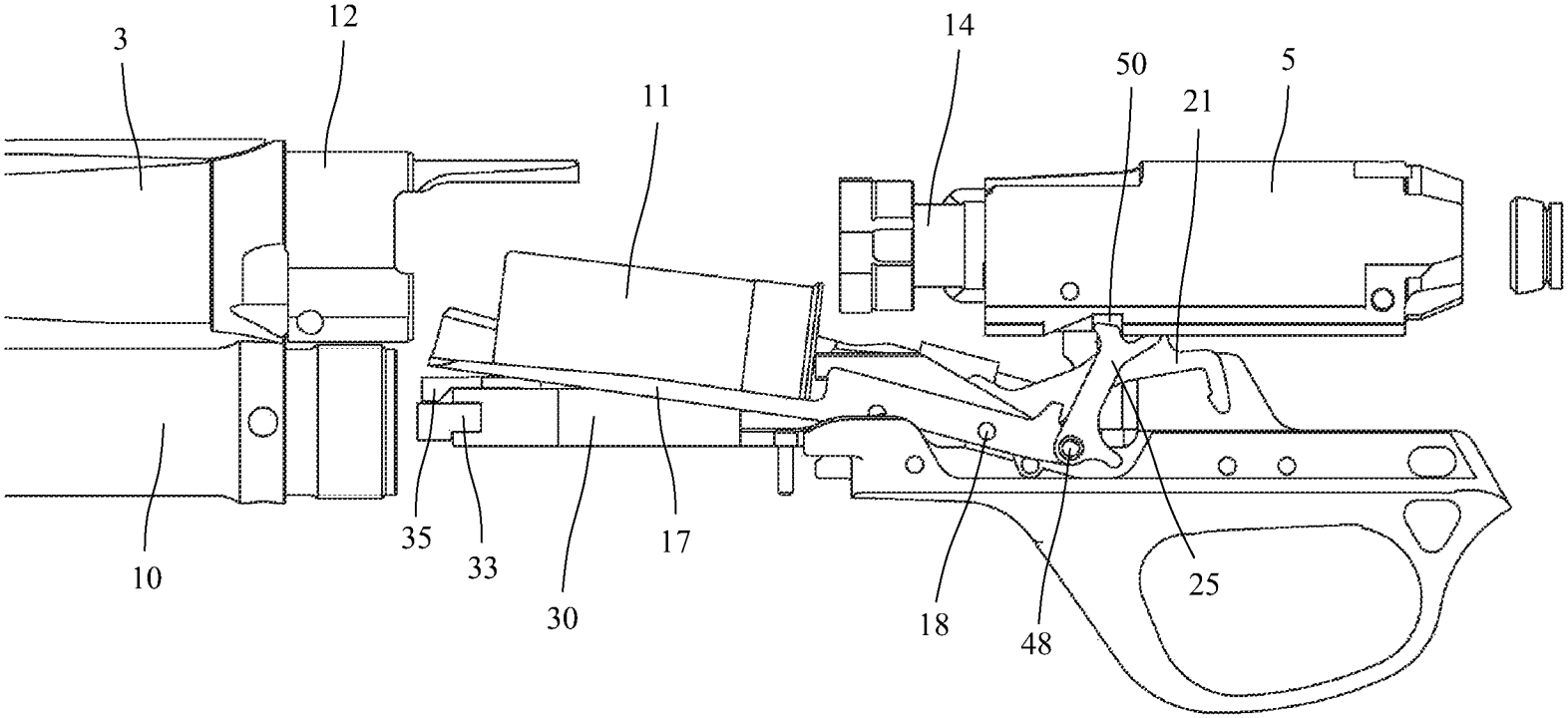
FIG. 11 a lateral view of the locking system shown in FIG. 3 with the feeder in a first feeding position, and FIG. 12 a lateral view of the locking system shown in FIG. 3 with the feeder in a second feeding position.
Figure 12:
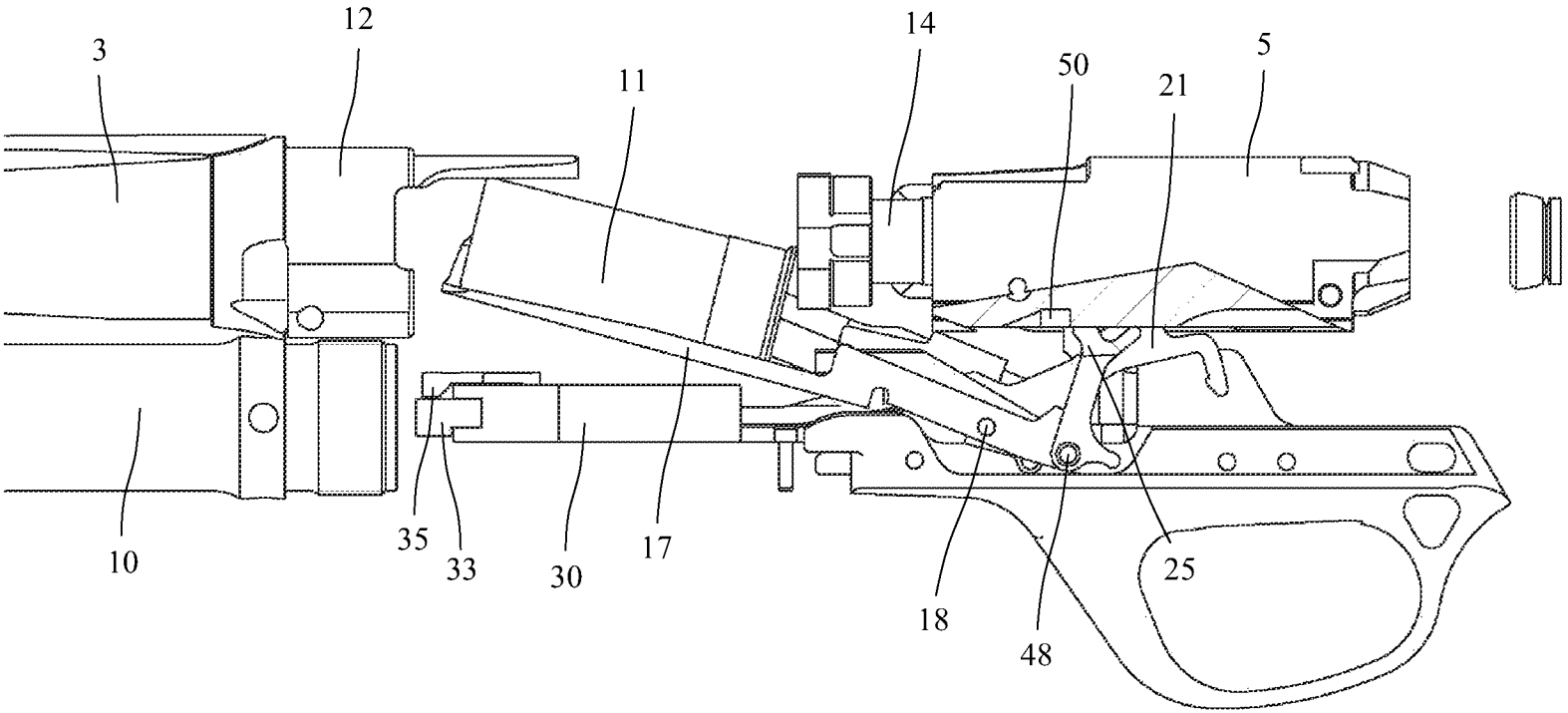

As the lock carrier 5 travels forwardly, the control element 25, configured in the form of a feeder lever, engages in an associated recess 50 on the lock carrier 5 as shown in FIG. 11, which causes the feeder 17 to be lifted as the lock carrier 5 continues to move forwardly. With respect to time and length, lifting the feeder 17, which is initiated by the lock carrier 5 via the control element 25, takes place in such a way that the lower edge of the locking head 14 reaches the edge of the lifted cartridge 11 only when the cartridge 11 can slide from the feeder 17 into the cartridge chamber 16 of the barrel 3. As the lock carrier 5 continues to travel forwardly, the feeder 17, as shown in FIG. 12, is lifted by the control element 25 to a level that allows the cartridge 11 to be inserted into the barrel 3 by the downstream lock carrier 5.

REFERENCE NUMBERS

1 Lock housing
2 Stock
3 Barrel
4 Forearm
5 Lock carrier
6 Loading lever
7 Trigger carrier
8 Trigger
9 Cartridge ejection window
10 Magazine
11 Cartridge
12 Locking sleeve
13 Thread
14 Locking head
15 Firing pin
16 Cartridge chamber
17 Feeder
18 Transverse axis
19 Tension rod
20 Compression spring
21 Hammer
22 Bearing part
23 Lock catch actuating element
24 Swivel axis
25 Control element
26 Rearward end of the lock catch actuating element
27 Vertical axis
28 Lock catch
29 Forward end of the lock catch actuating element

30 Magazine hatch
31 Axis
32 Axis
33 Holding element
34 Push knob
35 Toothed lever
36 Axis
37 Lock catch trigger
38 Push knob
39 Projection
40 Lug
41 Depression
42 Stop lever
43 Stop lug
44 Tilting lever
45 Transverse axis
46 Projection
47 Lug
48 Axis
49 Slope
50 Recess

What is claimed is:

1. A self-loading shotgun comprising:
a lock housing;
a lock movable inside the lock housing between an open position and a closed position;
a barrel;
a magazine disposed below the barrel;
a lock catch for holding the lock in the open position;
a feeder system lifting a cartridge fed from the magazine to the height of the barrel, the feeder system comprising a feeder that swivels about a transverse axis and a magazine hatch that interacts with the lock catch; and
a control element that is separate from the lock catch,
wherein the swivel movement of the feeder is generated by the lock via the control element that is separate from the lock catch.

2. The self-loading shotgun of claim 1, wherein the magazine hatch that swivels about an axis perpendicular with respect to an axis of the barrel is connected to the lock catch via a lock catch actuating element that is swivel-mounted on the feeder.

3. The self-loading shotgun of claim 2, wherein a rearward end, as seen when looking in a downrange direction, of the lock catch actuating element configured in the form of a two-arm lever interacts with the lock catch, which lock catch is disposed on a trigger carrier and swivels about an axis parallel to an axis of the magazine hatch.

4. The self-loading shotgun cited of claim 1, wherein the lock catch can be moved by a lock catch trigger, which is swivel-mounted in the lock housing, into a release position to release the lock.

5. The self-loading shotgun of claim 4, wherein the forward end, as seen when looking in a downrange direction, of the lock catch trigger has a lug for engaging in a semicircular depression on a rearward end, as seen when looking in the downrange direction, of the magazine hatch.

6. The self-loading shotgun of claim 1, wherein a linearly movable stop lever for detachably holding the magazine hatch in a locked position is dedicated to the magazine hatch.

7. The self-loading shotgun of claim 6, wherein the stop lever can be moved by a hammer disposed in the lock housing from a position of engagement with the magazine hatch into a release position.

8. The self-loading shotgun of claim 6, wherein the forward end, as seen when looking in a downrange direction, of the stop lever has a lug for locking engagement with the magazine hatch.

9. The self-loading shotgun of claim 6, wherein the stop lever is slidably guided inside the lock housing.

10. The self-loading shotgun of claim 7, wherein the lock lever can be moved by the hammer via a tilting lever.

11. The self-loading shotgun of claim 1, wherein the control element and the lock catch are separate components that are not connected to each other.

12. The self-loading shotgun of claim 11, wherein when the lock is in the open position, the feeder is not blocked and the magazine hatch is locked.

13. The self-loading shotgun of claim 12, wherein, because the control element and the lock catch are separate components that are not connected to each other, the magazine can be fully loaded when the lock is fully open.

14. The self-loading shotgun of claim 1, wherein when the lock is in the open position, the feeder is not blocked and the magazine hatch is locked.

15. The self-loading shotgun of claim 1, wherein the control element and the lock catch are separate components that are not connected to each other, so that the magazine can be fully loaded when the lock is fully open.

16. A self-loading shotgun comprising:
a lock housing;
a lock movable inside the lock housing between an open position and a closed position;
a barrel;
a magazine disposed below the barrel;
a lock catch for holding the lock in the open position;
a feeder system lifting a cartridge fed from the magazine to the height of the barrel, the feeder system comprising a feeder that swivels about a transverse axis and a magazine hatch that interacts with the lock catch; and
a control element that is separate from the lock catch,
wherein the swivel movement of the feeder generated by the lock is controlled by the control element that is separate from the lock catch, and
the control element, which interacts with the lock, is hinged to one end of the feeder so as to be able to swivel about an axis parallel to the transverse axis, said end, as seen when looking in a downrange direction, projecting rearwardly with respect to the transverse axis.

17. A self-loading shotgun with a lock movable inside a lock housing between an open position and a closed position, a barrel, a magazine disposed below the barrel, a lock catch for holding the lock in the open position, and a feeder system lifting a cartridge fed from the magazine to the height of the barrel, with the feeder system comprising a feeder that swivels about a transverse axis and a magazine hatch that interacts with the lock catch,
wherein the swivel movement of the feeder generated by the lock is controlled by a control element that is separate from the lock catch,
the magazine hatch that swivels about an axis perpendicular with respect to an axis of the barrel is connected to the lock catch via a lock catch actuating element that is swivel-mounted on the feeder, and
the lock catch actuating element is hinged to an upwardly projecting bearing part of the feeder so as to be able to swivel about a swivel axis perpendicular with respect to the transverse axis.

* * * * *